US005522230A

United States Patent [19]

Shima et al.

[11] Patent Number: 5,522,230

[45] Date of Patent: Jun. 4, 1996

[54] DRIVING CONTROL DEVICE FOR AIR CONDITIONER

[75] Inventors: Kiyoshi Shima; Kouichiro Tamakoshi, both of Osaka, Japan

[73] Assignee: Daikin Industries, Ltd., Osaka, Japan

[21] Appl. No.: 351,274

[22] PCT Filed: Apr. 11, 1994

[86] PCT No.: PCT/JP94/00604

§ 371 Date: Dec. 7, 1994

§ 102(e) Date: Dec. 7, 1994

[87] PCT Pub. No.: WO94/24492

PCT Pub. Date: Oct. 27, 1994

[30] Foreign Application Priority Data

Apr. 9, 1993 [JP] Japan ..... 5-083107

[51] Int. Cl.[6] ..... F24F 11/02

[52] U.S. Cl. ..... 62/127; 236/51; 165/22; 62/175

[58] Field of Search ..... 62/125, 126, 127, 62/129, 161, 162, 163, 164, 298, 175; 236/51, 94; 165/11.1, 22

[56] References Cited

U.S. PATENT DOCUMENTS

| | | | |
|---|---|---|---|
| 4,682,648 | 7/1987 | Fried | 165/22 X |
| 4,811,897 | 3/1989 | Kobayashi et al. | 236/51 X |
| 5,279,458 | 1/1994 | DeWolf et al. | 236/51 X |

FOREIGN PATENT DOCUMENTS

| | | |
|---|---|---|
| 50-62344 | 6/1975 | Japan . |
| 55-61243 | 4/1980 | Japan . |
| 55-116042 | 9/1980 | Japan . |
| 64-54164 | 3/1989 | Japan . |
| 28646 | 1/1990 | Japan . |
| 285634 | 3/1990 | Japan . |
| 2203146 | 8/1990 | Japan . |
| 3213146 | 9/1991 | Japan . |

*Primary Examiner*—Harry B. Tanner
*Attorney, Agent, or Firm*—Sixbey, Friedman, Leedom & Ferguson; Gerald J. Ferguson, Jr.

[57] ABSTRACT

A setting button (53) for setting an option for changing a driving mode is provided in any one of indoor control units (3) belonging to each of refrigerant control systems (12, 13). An outdoor control unit (2) sets to each indoor control unit (3) a system number of the refrigerant control system (12, 13) to which each indoor control unit (3) belongs. The indoor control unit (3) outputs an option holding signal and a system signal of the system number. A integral controller (4) is provided with a system indicating button (*6a*) for indicating the option and the refrigerant control system (12, 13). Further, the integral controller (4) is provided with an option indicating lamp (HSM) for indicating the option and a system indicating lamp (HLM) for indicating the refrigerant control system (12, 13).

14 Claims, 11 Drawing Sheets

DRIVING CONTROL DEVICE FOR AIR CONDITIONER

[TECHNICAL FIELD]

This invention relates to a driving control device for an air conditioner with a plurality of air conditioning control systems, in particular, relates to measures for indication in an integral control unit.

[BACKGROUND ART]

In conventional air conditioners, as shown in the Japanese Patent Laying Open Gazette No. 3-213941, a plurality of indoor control units for controlling respective indoor units are connected to an outdoor control unit for controlling an outdoor unit via branch control units, and a remote control is connected to the indoor control units, in which temperature setting and driving mode are switched by the remote control.

In addition, a group of the indoor control units connected to each branch control unit control air conditioning in the same driving mode. Since a plurality of remote controls may be connected to each group of the indoor control units, an option to switch the driving mode can be set to one of the remote controls, i.e., one of the indoor control units, so that the driving mode can be switched only by the remote control having the above option.

Problems to be solved

In the above-mentioned air conditioner, the remote control is connected to the indoor control unit to switch the driving mode and the like and indicates the present driving mode. Thus, the air conditioner has a disadvantage in operability.

In detail, recently, the number of indoor units to be provided in a single air conditioner has been increased so that the desire to control many indoor units at a single place has grown. In particular, there is a case where a plurality of outdoor units are provided. In this case, just indicating the option to switch the driving mode by the remote control as in the conventional device invites a problem of the impossibility of integral management.

More specifically, in the integral management of air conditioning, it is required to recognize which outdoor control unit each indoor control unit belongs to and which indoor control unit has the option for switching the driving mode. A new driving control device having the ability of the above recognitions has been desired.

This invention has been made in view of the forgoing problems and has its object of integrally managing the air conditioning control systems to which respective user-side control units belong and the options for switching the driving mode.

[DISCLOSURE OF INVENTION]

To attain the above object, this invention is designed to indicate in an integral control unit the air conditioning control system to which the user-side control units belong and the option for switching the driving mode.

Constitution

In detail, as shown in FIG. 1, a subject of claim 1 of the present invention is a driving control device for an air conditioner having: a plurality of air conditioning control systems (12, 13) each so formed that a plurality of user-side control units (3) are connected to a thermal source side control unit (2) via a transmission line (11); and an integral control system (15) so formed that an integral control unit (4) is connected to all the user-side control units (3) via a transmission line (14).

Further, there is provided an option means (53) for setting, to any one of the user-side control units (3) of each of the air conditioning control systems (12, 13), an option which enables a switching operation of a driving mode of the air conditioning control system (12, 13).

Furthermore, in each of the user-side control units (3), there is provided an:option transmitting means (36) for outputting an option holding signal when the option is set to the user-side control unit (3) by the option means (53).

In addition, the integral control unit (4) is provided with: an indication input means (6a) for inputting an indication instruction for indicating a required user-side control unit (3) out of the user-side control units (3) each having the option; and an indication executing means (43) for indicating the instructed user-side control unit (3) having the option based on the option holding signal transmitted from the option transmitting means (36) of the user-side control unit (3) when receiving the indication instruction from the indication input means (*6a*).

In a driving control device of claim 2, the indication executing means (43) according to claim 1 has: a data collecting means (44) for, when inputting the indication instruction from the indication input means (*6a*), collecting transmission signals from all the user-side control units (3) which each include the option holding signal and extracting the instructed user-side control unit (3) having the option to output an indication unit signal; and an option indicating means (HSM) for indicating the user-side control unit (3) having the option in response to the indication unit signal of the data collecting means (44).

In a driving control device of claim 3, instead of the driving control device of claim 2, the indication executing means (43) according to claim 1 has: a storage means (45) for storing data of the user-side control units (3) each having the option based on the option holding signals of the option transmitting means (36); a read-out means (46) for, when inputting the indication instruction from the indication input means ( *6a*), reading out data stored in the storage means ( 45 ), extracting the instructed user-side control unit (3) having the option and then outputting the indication unit signal; and an option indication means (HSM) for indicating the user-side control unit (3) having the option in response to the indication unit signal of the read-out means (46).

A subject of claim 4 of this invention is, as in claim 1, a driving control device of an air conditioner having a plurality of air conditioning control systems (12, 13) and an integral control system (15).

Further, a thermal source side control unit (2) is provided with a system number setting means (25) for setting respective system numbers of the air conditioning control systems (12, 13) to respective user-side control units (3) connected to the thermal source side control unit (2), storing the system numbers and outputting system signals of the system numbers.

Furthermore, each of the user-side control units (3) is provided with a system transmitting means (37) for receiving a system signal outputted from the system number setting means (25), storing the system signal and outputting the system signal.

In addition, an integral control unit (4) is provided with: an indication input means (*6a*) for inputting an indication instruction for indicating the user-side control units (3) belonging to required one of the air conditioning control systems (12, 13); and an indication executing means (43) for indicating, when inputting the indication instruction from the indication input means (6*a*), the user-side control units (3) belonging to the instructed air conditioning control system (12, 13) based on the system signals transmitted from the system transmitting means (37) of the user-side control units (3).

In a driving control device of claim 5, the indication executing means (43) according to claim 4 has: a data collecting means (44) for, when inputting the indication instruction from the indication input means (6*a*), collecting transmission signals from all the user-side control units (3) which each include the system signal and extracting the user-side control units (3) belonging to the instructed air conditioning control system (12, 13) to output an indication system signal; and a system indicating means (HLM) for indicating the user-side control units (3) in response to the indication system signal of the data collecting means (44).

In a driving control device of claim 6, instead of the driving control device of claim 5, the indication executing means (43) according to claim 4 has: a storage means (45) for storing data of the air conditioning control systems (12, 13) to which respective user-side control units (3) belong based on the system signals of the system transmitting means (37); a read-out means (46) for, when inputting the indication instruction from the indication input means (6*a*), reading out data stored in the storage means (45), and extracting the user-side control units which belong to the instructed air conditioning control unit (12, 13) to output an indication system signal; and a system indicating means (HLM) for indicating the user-side control units (3) in response to the indication system signal of the read-out means (46).

A driving control device of claim 7 is a combination of the driving control devices of claims 1 and 4 and its subject is a driving control device of an air conditioner having a plurality of air conditioning control systems (12, 13) and an integral control system (15).

Further, there is provided an option means (53) for setting, to any one of the user-side control units (3) of each of the air conditioning control systems (12, 13), an option which enables a switching operation of a driving mode of the air conditioning control system (12, 13).

Furthermore, a thermal source side control unit (2) is provided with a system number setting means (25) for setting respective system numbers of the air conditioning control systems (12, 13) to respective user-side control units (3) connected to the thermal source side control unit (2), storing the system numbers and outputting system signals of the system numbers.

Moreover, each of the user-side control units (3) is provided with: an option transmitting means (36) for outputting an option holding signal when the option is set to the user-side control unit (3) by the option means (53); and a system transmitting means (37) for receiving a system signal outputted from the system number setting means (25), storing the system signal and outputting the system signal.

In addition, an integral control unit (4) is provided with: an indication input means (6*a*) for inputting an indication instruction for indicating a required user-side control unit (3) out of the user-side control units (3) which each have the option and indicating the user-side control units (3) belonging to a required one out of the air conditioning control systems ( 12, 13 ); and an indication executing means ( 43 ) for, when inputting the indication instruction from the indication input means (6*a*), indicating the instructed user-side control unit (3) having the option based on the option holding signal transmitted from the option transmitting means (36) of the user-side control unit (3), and indicating the user-side control units (3) belonging to the instructed air conditioning control system (12, 13) based on the system signals transmitted from the system transmitting means (37) of the user-side control units (3).

In a driving control device of claim 8, the indication executing means (43) according to claim 7 has: a data collecting means (44) for, when inputting the indication instruction from the indication input means (6*a*), collecting transmission signals from all the user-side control units (3) which each include the option holding signal and the system signal, extracting the instructed user-side control unit (3) having the option to output an indication unit signal, and extracting the user-side control units (3) belonging to the instructed air conditioning control system (12, 13) to output an indication system signal; an option indicating means (HSM) for indicating the user-side control unit (3) having the option in response to the indication unit signal of the data collecting means (44); and a system indicating means (HLM) for indicating the user-side control units (3) in response to the indication system signal of the data collecting means (44).

In a driving control device of claim 9, instead of the driving control device of claim 8, the indication executing means (43) according to claim 7 has: a storage means (45) for storing data of the user-side control units (3) each having the option based on the option holding signals of the option transmitting means (36) and for storing data of the air conditioning control systems (12, 13) to which respective user-side control units (3) belong based on the system signals of the system transmitting means (37); a read-out means (46) for, when inputting the indication instruction from the indication input means (6*a*), reading out data stored in the storage means (45), extracting the instructed user-side control unit (3) having the option to output an indication unit signal, and extracting the user-side control units (3) belonging to the instructed air conditioning control system (12, 13) to output an indication system signal; an option indicating means (HSM) for indicating the user-side control unit (3) having the option in response to the indication unit signal of the readout means (46); and a system indicating means (HLM) for indicating the user-side control units (3) in response to the indication system signal of the read-out means (46).

A driving control device of claim 10 is so composed that, in accordance with any one of claims 1 to 9, the indication input means (6*a*) is an indicating button for inputting the indication instruction with the push of the indicating button.

A driving control device of claim 11 according to any one of claims 4 to 6 is so composed that, in order to indicate the user-side control units (3) belonging to any one of the air conditioning control systems (12, 13), the indication input means (6*a*) inputs indication instruction information designating one user-side control unit (3) belonging to that one of the air conditioning control systems (12, 13).

A driving control device of claim 12 according to any one of claims 7 to 9 is so composed that, in order to indicate the user-side control unit (3) having the option of any one of the air conditioning control systems (12, 13) and indicate the user-side control units (3) belonging to that one of the air conditioning control systems (12, 13), the indication input means (6*a*) inputs indication instruction information designating one user-side control unit (3) belonging to that one of the air conditioning control systems (12, 13).

A driving control device of claim 13 is so composed that, in accordance with any one of claims 1 to 3 and 7 to 9, the option indicating means (HSM) is an option indicating lamp which flashes in response to the indication unit signal.

A driving control device of claim 14 is so composed that, in accordance with any one of claims 4 to 9, the system indicating means (HLM) is a system indicating lamp which continuously illuminates in response to the indication system signal.

Operations

With the above structure, in the driving control devices of claims 1 and 7, a control signal is transmitted and received between the thermal source side control unit (2) and the plurality of user-side control units (3) and a control signal is transmitted and received between all the user-side control units (3) and the integral control unit (4).

In each of the air conditioning control systems (12, 13), the option which enables a switching operation of a driving mode of the air conditioning control system (12, 13) is set to any one out of the user-side control units (3) by the option means (53). When the option is set by the option means (53), the option transmitting means (36) of the user-side control unit (3) outputs an option holding signal. On the other hand, when an indication instruction for indicating the user-side control unit (3) having the option is inputted to the integral control unit (4), the indication executing means (43) indicates the instructed user-side control unit (3) having the option based on the option holding signal transmitted from the user-side control unit (3).

Specifically, in the driving control devices of claims 2 and 8, the indication instruction is inputted from the indication input means (6*a*). For example, in the driving control device of claim 10, when the indicating button is pushed, the data collecting means (44) collects transmission signals of all the user-side control units (3) each including the option holding signal, extracts the instructed user-side control unit (3) having the option and outputs an indication unit signal. Then, the option indicating means (HSM) indicates the user-side control unit (3) having the option in response to the indication unit signal of the data collecting means (44).

In the driving control devices of claims 3 and 9, at the time of, for example, installation, the storage means (45) stores data of the user-side control units (3) each having the option based on the option holding signals of the option transmitting means (36). Thereafter, when an indication instruction is inputted from the indication input means (6*a*), the read-out means (46) reads out data stored in the storage means (45), extracts the instructed user-side control unit (3) having the option and outputs an indication unit signal. Then, the option indicating means (HSM) indicates the user-side control unit (3) having the option in response to the indication unit signal of the read-out means (46).

For example, in the driving control device of claim 13, the option indicating lamp (HSM) flashes in response to the indication unit signal.

In the driving control devices of claims 4 and 7, the system number setting means (25) of the thermal source side control unit (2) counts up addresses of the user-side control units (3) connected to the thermal source side control unit (2), sets respective system numbers of the air conditioning control systems (12, 13) to store them and outputs system signals respectively indicating the system numbers. Then, each of the user-side control units (3) receives the system signal so that the system transmitting means (37) outputs the system signal. On the other hand, when an indication instruction for indicating the user-side control units (3) belonging to one of the air conditioning control systems (12, 13) is inputted to the integral control unit (4), the indication executing means (43) indicates the user-side control units (3) belonging to that one of the air conditioning control systems (12, 13) based on the system signals transmitted from the user-side control units Specifically, in the driving control devices of claims 5 and 8, the indication instruction is inputted from the indication input means (6*a*). For example, in the driving control device of claim 10, the indicating button is pushed. In the driving control devices of claims 11 and 12, indication instruction information designating one of the user-side control units (3) belonging to any one of the air conditioning control systems (12, 13) is inputted. Then, the data collecting means (44) collects transmission signals of all the user-side control units (3) each including a system signal, extracts the user-side control units (3) belonging to the instructed air conditioning control system (12, 13) and outputs an indication system signal. Thereafter, the system indicating means (HLM) indicates the user-side control units (3) in response to the indication system signal of the data collecting means (44).

In the driving control devices of claims 6 and 9, at the time of, for example, installation, the storage means (45) stores data of the air conditioning control systems (12, 13) to which respective user-side control units (3) belong based on system signals of the system transmitting means (37). Thereafter, when an indication instruction is inputted from the indication input means (6*a*), the read-out means (46) reads out data stored in the storage means (45), and outputs an indication system signal indicating the user-side control units (3) belonging to the instructed air conditioning control system (12, 13). Then, the system indicating means (HLM) indicates the user-side control units (3) in response to the indication system signal of the read-out means (46).

For example, in the driving control device of claim 14, the system indicating lamp (HLM) continuously illuminates in response to the indication system signal.

Effects

According to the driving control device of claim 1, when an option is set to any one of the user-side control units (3) in each of the air conditioning control systems (12, 13), the user-side control unit (3) having the option is indicated on the integral control unit (4). Consequently, the user-side control unit (3) having the option can be readily recognized on the integral control unit (4). As a result, switching and management of the driving mode can be made at the integral control unit (4) thereby improving operability.

According to the driving control device of claim 2, when an indication instruction is inputted, transmission signals outputted from the user-side control units (3) are collected so that the user-side control unit (3) having the option is identified. Consequently, the user-side control unit (3) having the option newly can be identified in every indication. As a result, in the cases where the user-side control unit (3) to have the option is changed or where a new air conditioning control system is additionally provided, the user-side control unit (3) having the option can be accurately identified and indicated.

According to the driving control device of claim 3, data of the user-side control units (3) each having the option is previously stored, and then the user-side control unit (3) having the option is identified from the stored data when an indication instruction is inputted. Accordingly, the indication of the user-side control unit (3) having the option can be immediately made after the indication instruction, thereby readily executing a prompt integral management.

According to the driving control device of claim 4, since the thermal source side control unit (2) sets the system numbers and the user-side control units (3) belonging to one of the air conditioning control systems (12, 13) are indicated on the integral control unit (4), the user-side control units (3) belonging to each of the air conditioning control systems (12, 13) can be readily recognized. As a result, the air conditioning control systems(12, 13) to which respective user-side control units (3) belong can be managed at the integral control unit (4) and a check of the systems just after the installation can be readily made, thereby improving service.

In addition, since the system numbers are automatically set by the thermal source side control unit (2), the system numbers can be accurately set and missetting such as duplication can be prevented, thereby resulting in accurate management.

According to the driving control device of claim 5, when an indication instruction is inputted, transmission signals outputted from the user-side control units (3) are collected so that the user-side control units (3) belonging to each of the air conditioning control systems (12, 13) are identified. Consequently, the air conditioning control system ( 12, 13 ) to which the user-side control units (3) belong can be newly recognized in every indication. As a result, in the cases where the air conditioning control system (12, 13) to which the user-side control units (3) belong is changed or where a new air conditioning control system is additionally provided, the air conditioning control systems (12, 13) to which respective user-side control units (3) belong can be accurately identified and indicated.

According to the driving control device of claim 6, data of the user-side control units (3) belonging to each of the air conditioning control systems (12, 13) is previously stored, and then the air conditioning control system (12, 13) to which the user-side control units (3) belong are identified from the stored data when an indication instruction is inputted. Accordingly, the indication of the air conditioning control system (12, 13) to which the user-side control units (3) belong can be immediately made after the indication instruction, thereby readily executing a prompt integral management.

According to the driving control device of claim 7, since the user-side control units (3) belonging to each of the air conditioning control systems (12,13) and the user-side control unit (3) having the option are indicated on the integral control unit (4), judgment whether a desired user-side control unit (3) is switched in driving mode can be readily made at the integral control unit (4) when the driving mode of any one of the user-side control units (3) has been switched. Accordingly, switching of the driving mode can be made readily and accurately at the integral control unit (4).

According to the driving control device of claim 8, since the user-side control unit (3) having the option and the user-side control units (3) belonging to each of the air conditioning control systems (12, 13) are identified every time an indication instruction is inputted, switching of the driving mode can be accurately made at the integral control unit (4) even in the case where the option is changed.

According to the driving control device of claim 9, since data of the user-side control units (3) having the option and the user-side control units (3) belonging to respective air conditioning control systems (12, 13) is previously stored, switching of the driving mode can be made in a short time after the indication instruction, thereby readily executing a prompt integral management.

According to the driving control device of claim 10, an indication instruction can be inputted by the indicating button, thereby simplifying an indication operation.

According to the driving control devices of claims 11 and 12, since a system indication or the like is made by designating one user-side control unit (3) and inputting information thereof, desired information can be obtained by a simple inputting.

According to the driving control devices of claims 13 and 14, since different lamp indications are made between an option indication and a system indication, this can surely prevent from the misrecognition of confusing the option indication with the system indication.

In particular, according to the driving control device of claim 13, since the option indication is indicated by flashing, one user-side control unit (3) having the option can be recognized accurately and readily.

[BEST MODE FOR CARRYING OUT THE INVENTION]

Description is made below about embodiments of this invention with reference to the drawings.

First embodiment

The present embodiment shows an embodiment according to claims 7, 8, 10, 12, 13 and 14.

Figure 1:
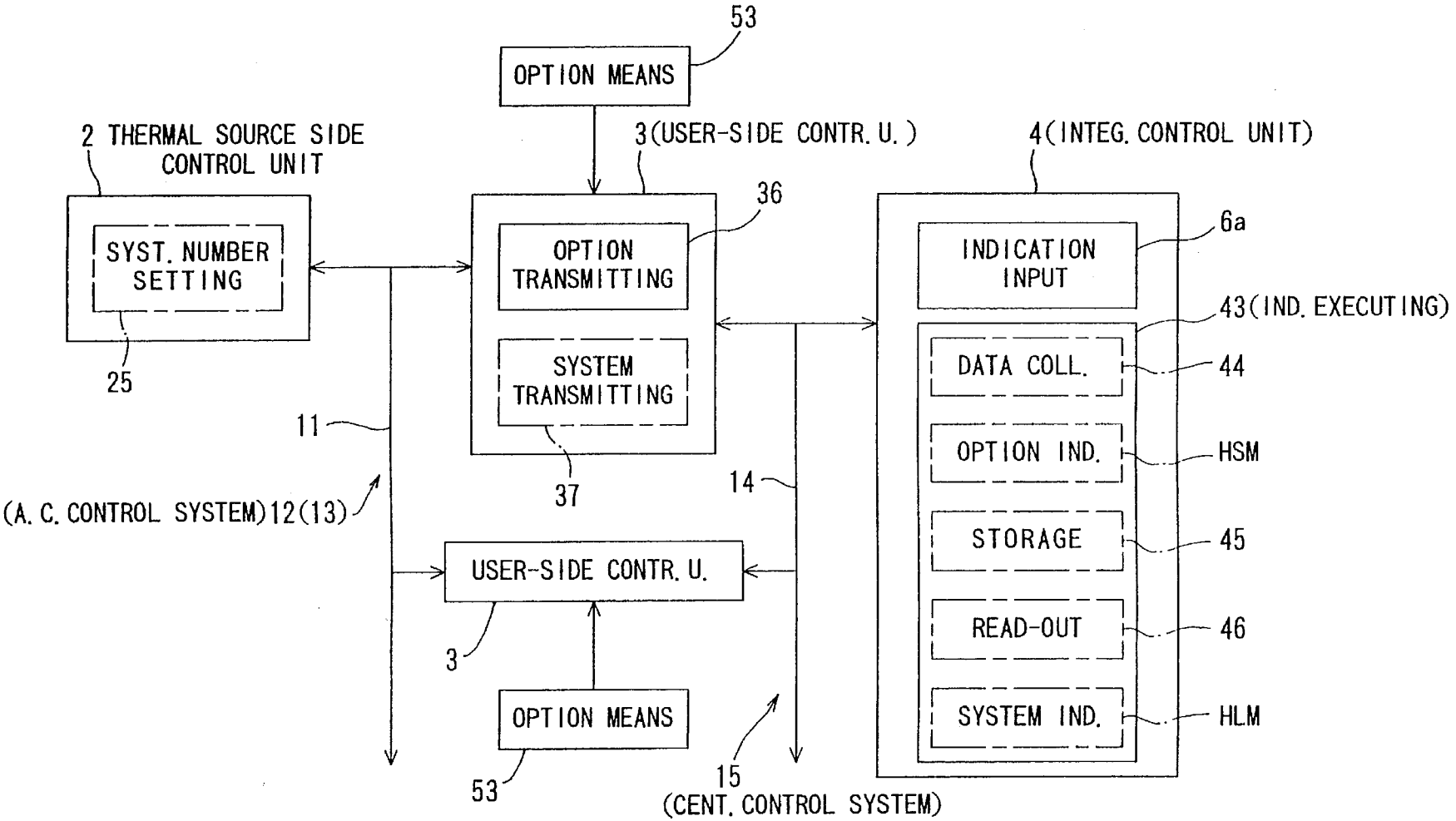
FIG. 1 is a block diagram showing the structure of a driving control device for an air conditioner of this invention.
Figure 2:
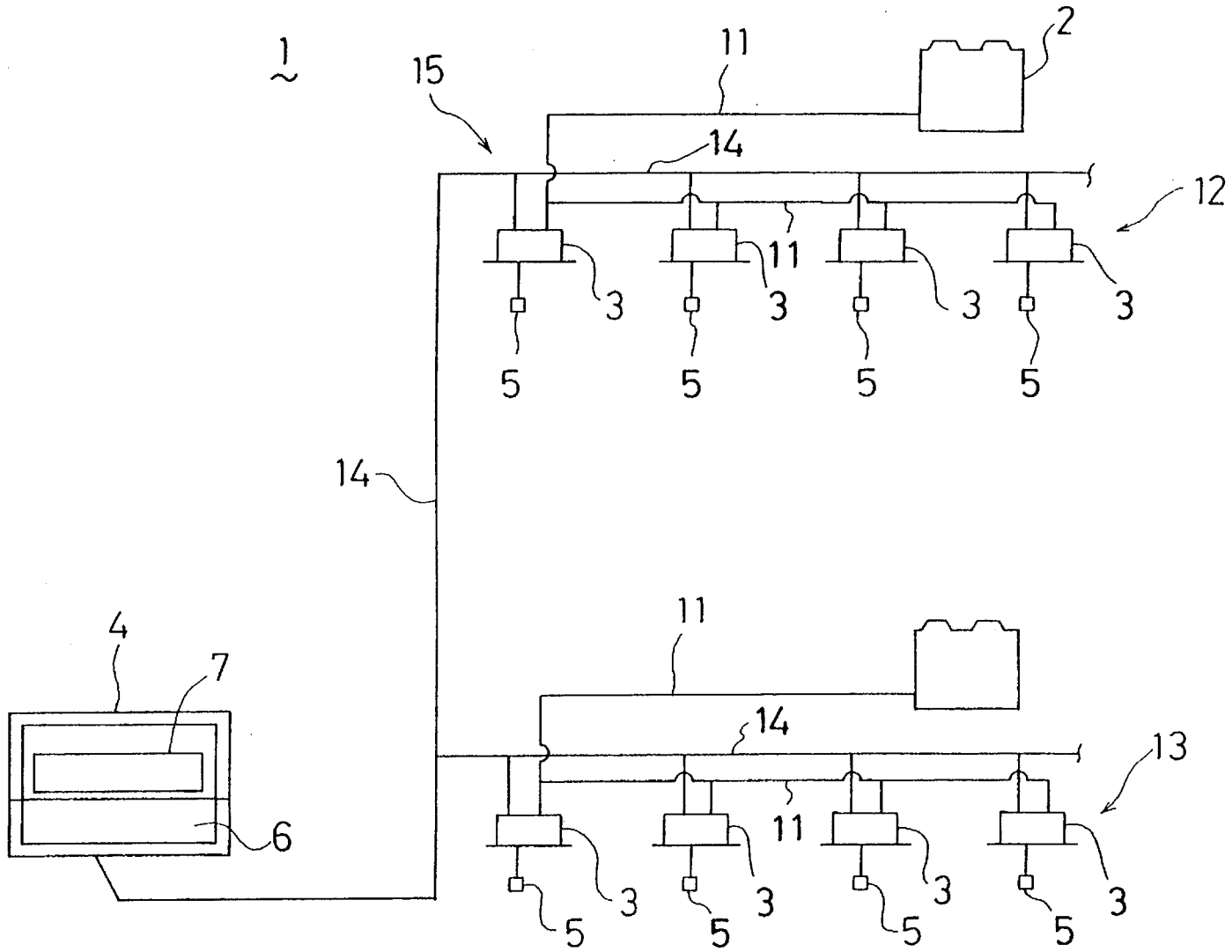
FIG. 2 is a diagram showing a system configuration of control systems of the air conditioner.

FIG. 2 is a diagram showing a system configuration of control systems of an air conditioner (1). The air conditioner (1) comprises: outdoor control units (2) as thermal source side control units for controlling outdoor units respectively; indoor control units; (3) as user-side control units for controlling indoor units respectively; an integral controller (4) as an integral control unit for integrally controlling all the indoor control units (3); and remote controls (5) which are connected to the indoor control units (3) respectively and individually control! each of the indoor control units (3).

In each of the outdoor control units (2), a plurality of, for example, a maximum of eight indoor control units (3) are connected to each other via a transmission line (11) to form a refrigerant control system (12, 13) as one air conditioning control system. In FIG. 2, a first refrigerant control system (12) and a second refrigerant control system ( 13 ) are formed as two refrigerant control systems (12, 13). In other words, the first refrigerant control system (12) and the second refrigerant control system (13) which are respective air conditioning control systems each form one refrigerant circulating system. The outdoor control unit (2) and the indoor control units (3) in each of the refrigerant control systems (12, 13) are composed so as to drive in the same driving mode.

Further, the integral controller (4) is connected to all the indoor control units (3) via a transmission line (14) to form an integral control system (15). The integral controller (4) is composed so as to integrally control a maximum of 64 indoor control units (3) forming a maximum of 64 refrigerant control systems (12, 13, . . . ).

Figure 3:
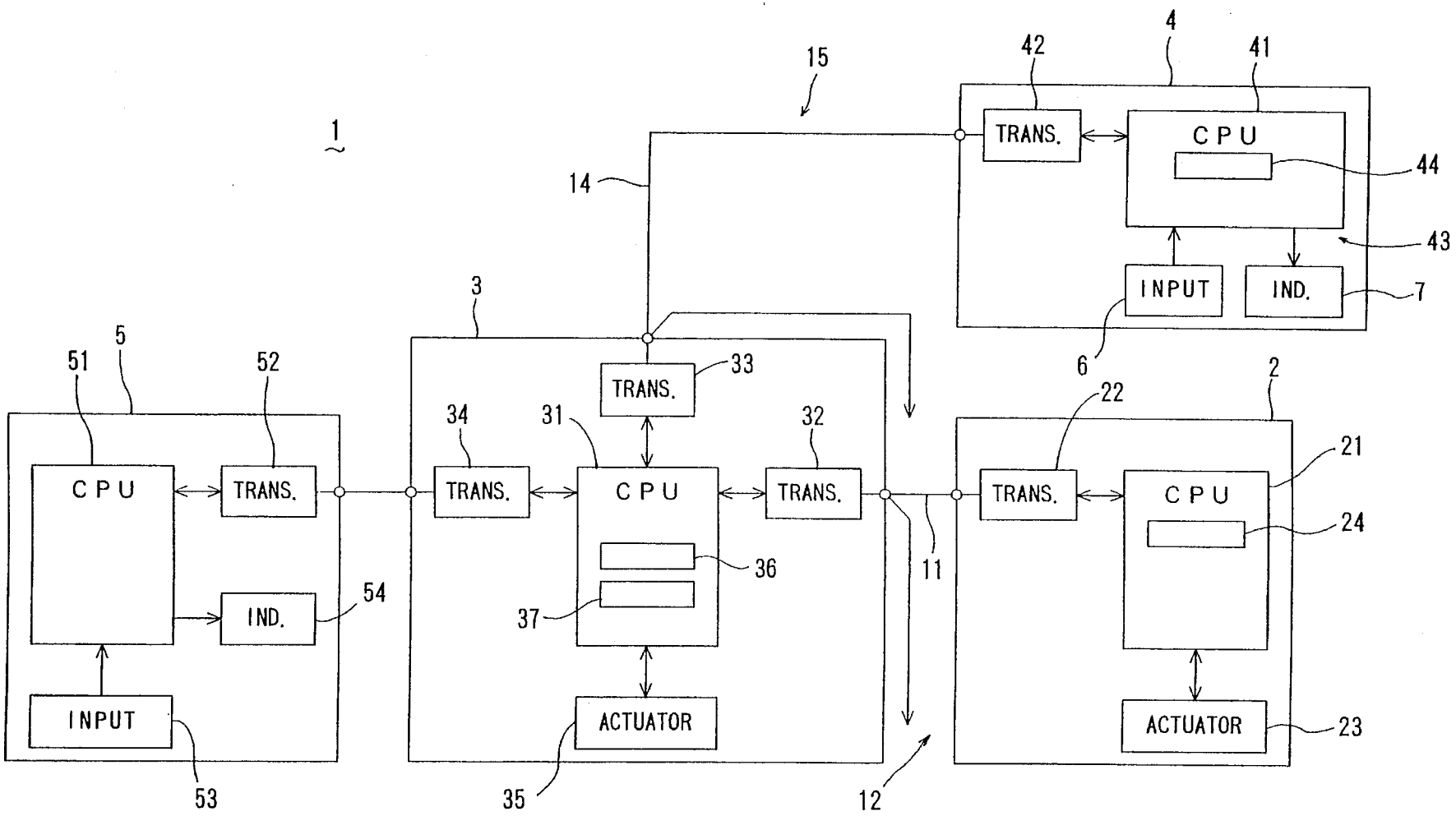
FIG. 3 is a block diagram showing the control systems of the air conditioner.

As shown in FIG. 3, each of the outdoor control units (2) has an outdoor CPU (21). The outdoor CPU (21) is connected to the indoor control units (3) via a transmission circuit part (22) for transmitting and receiving a control signal, and is connected to an actuator (23) such as a compressor and an outdoor fan to control the actuator (23).

As shown in FIG. 3, each of the indoor control unit (3) has an indoor CPU (31). The indoor CPU (31) is connected to the outdoor control unit (2), the integral controller (4) and the remote controller (5) via transmission circuit parts (32, 33, 34) for each transmitting and receiving a control signal respectively, and is connected to an actuator (85) such as an indoor fan to control the actuator (35).

As shown in FIG. 3, the remote control (5) has a remote control CPU (51). The remote control CPU (51) is connected to the indoor control unit (3) via a transmission circuit part (52) for transmitting and receiving a control signal, and is connected to a remote control input means (53) and a remote control indicating means (54). The remote control input means (53) has a driving mode switching button, a temperature setting button and the like which are not shown, and is so composed that the driving mode such as a cooling operation and a heating operation, a set temperature and the like are inputted thereto. The remote control indicating means (54) has a drive lamp, a temperature indicating part and the like which are not shown, and is so composed that the driving mode such as a cooling operation and a heating operation, a set temperature and the like are indicated.

Further, the remote control input means (53) has an option setting button for setting an option to form an option means. In detail, the remote control input means (53) is composed so as to set an option which enables a switching operation of a driving mode of each of the refrigerant control systems (12, 13) to any one of the indoor control units (3) of each of the refrigerant control systems (12, 13), and is so composed that only the remote control (5) connected to the indoor control unit (3) to which the option is set can switch the driving mode of one refrigerant control system (12, 13).

Figure 4:
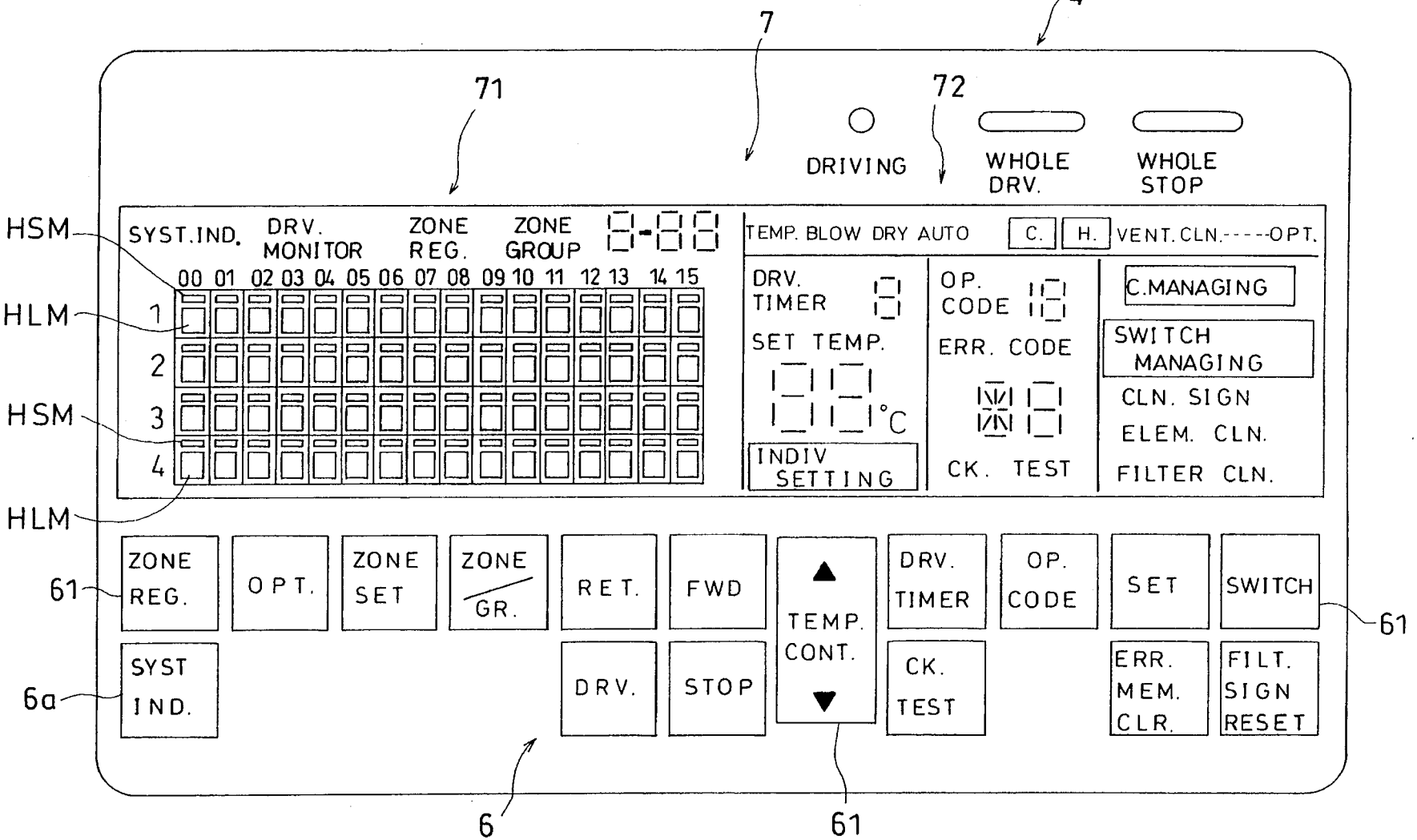
FIG. 4 is a front elevation showing an integral controller.

Furthermore, as shown in FIG. 3, the integral controller (4) has an integral CPU (41). The integral CPU (41) is connected to the indoor control units (3) via a transmission circuit part (42) for transmitting and receiving a control signal, and is connected to an integral input means (6) and an integral indicating means (7). As shown in FIG. 4, the integral input means (6) is provided at the lower portion in front of a main body of the controller (4), and is composed of many operating buttons (61) for performing a driving operation, a temperature adjusting operation, a driving mode switching operation and the like. As one of features of this invention, a system indicating button (6*a*) which is one of the operating buttons (61) forms an indication input means which inputs an indication instruction for indicating a required indoor control unit (3) out of the indoor control units (3) each having the option and which inputs indication instruction information designating one indoor control unit (3) in order to indicate the indoor control units (3) belonging to a required one out of the refrigerant control systems (12, 13).

Further, the integral indicating means (7) is provided at the lower portion in front of the main body, and is composed of: a first indicating part (71) for individually indicating a driving state or the like of each of the indoor control units (3) by a lamp or the like; and a second indicating part (72) for indicating a selected temperature, a driving timer, an error code and the like by segments. The first indicating part (71) is provided with: an option indicating lamp (HSM) as an option indicating means for indicating by light the indoor control unit (3) having the option based on an option holding signal transmitted from the indoor control unit (3) when an indication instruction is inputted from the system indicating button (6*a*); and a system indicating lamp (HLM) as a system indicating means for indicating by light the indoor control units (3) belonging to the instructed refrigerant control system (12, 13) based on system signals transmitted from the indoor control units (3) when an indication instruction is inputted from the system indicating button (6*a*).

Specifically, as one of features of this invention, the integral controller (4) is provided with an indication executing means (43). The indication executing means (43) is composed so as to indicate the instructed indoor control unit (3) having the option based on an option holding signal from the indoor control unit (3) and indicate the indoor control units (3) belonging to the instructed refrigerant control system (12, 13) based on system signals from the indoor control units (3). The indication executing means (43) is composed of a data collecting means (44) provided in the integral CPU (41), the option indicating lamp (HSM) and the system indicating lamp (HLM).

Every time; an indication instruction is inputted by the push of the system indicating button (6*a*), the data collecting means (44) collects transmission signals of all the indoor control units (3), i.e., transmission data, extracts the instructed indoor control unit (3) having the option to output an indication unit signal, and extracts the indoor control units (3) belonging to the instructed refrigerant control system (12, 13) to output an indication system signal.

Then, the option indicating lamp (HSM) flashes in response to the indication unit signal while the system indicating lamp (HLM) continuously illuminates in response to the indication system signal.

Furthermore, as one of features of this invention, the outdoor CPU (21) is provided with a system number setting means (25) for counting up indoor addresses of the indoor control units (3) connected to the outdoor control unit (2), setting the maximum value of the indoor addresses of the indoor control units (3) as a system number of the refrigerant control system (12, 13) to which the indoor control units (3) belong, storing the number, and outputting a system signal of the system number.

The indoor CPU (31) is provided with: an option transmitting means (36) for outputting an option holding signal when the option is set by the remote control input means (53) as the option means; and a system transmitting means (37) for receiving a system signal outputted from the system number setting means (25) to store it and for outputting the system signal.

Control Operations of First Embodiment

Description is made next about a driving control operation of the air conditioner (1).

First, a control signal is transmitted and received between each remote control (5) and each indoor control unit (3). A control signal is transmitted and received between the outdoor control unit (2) and each of the indoor control units (3) in each of the first and second refrigerant control systems (12, 13), while control signals are transmitted and received between the integral controller (4) and all the indoor control units (3). When inputting a driving signal or the like from the remote control input means (53) of the remote control (5), the indoor control unit (3) connected to the remote control (5) controls air conditioning by the driving signal or the like. On the other hand, when inputting a driving signal or the like from the operating button (61) of the integral controller (4), the indoor control unit (3) controls air conditioning. That is, all the indoor control units (3) can be operated by the integral controller (4).

Description is made next about a setting operation and an indication operation of a system number and an indication operation of an option.

Figure 5:
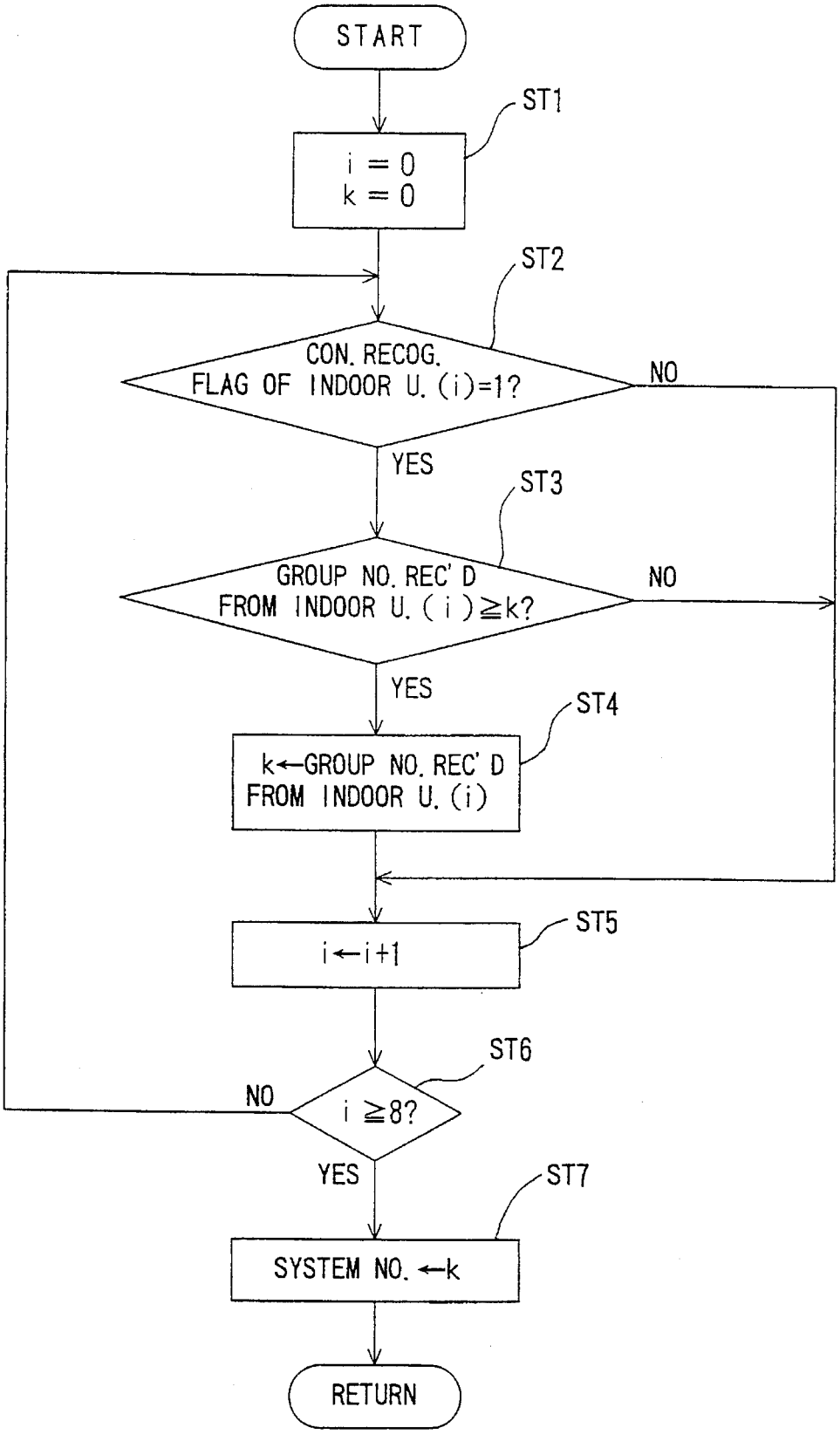
FIG. 5 is a control flow chart for setting system numbers in an outdoor control unit.

FIG. 5 shows a control operation of the outdoor control unit (2). When first the routine starts, a variable i for count for counting the indoor control units (3) and a variable k for group for setting the system number are initially set to 0 at Step ST1.

Successively, the routine proceeds to Step ST2, where judgment is made about whether or not a connection recognition flag with respect to the indoor control unit (3) of the variable i for count is set. In detail., since the connection recognition flag is set if the indoor control unit (3) of the variable i for count is connected, the judgment at Step ST2 is YES when the connection recognition flag is set, so that the routine proceeds from Step ST2 to Step ST3. Then, at Step ST3, judgment is made about whether or not a group number received from the indoor control unit (3) is larger than a variable k for group.

In detail, different indoor addresses are previously set to every indoor control units while a group number of the indoor control unit (3) to be controlled by a single remote control (5) is set. In this embodiment, the remote control (5) is connected to each of the indoor control units (3). Accordingly, the indoor address specifying each indoor control unit (3) is the group number. Then, whether or not the indoor address is larger than the variable k for group is judged. Since the variable k for group is initially set to 0, the indoor address is first set to the variable k for group.

Next, the routine proceeds to Step ST5, where the variable i for count is incremented by 1 so that the routine proceeds to Step ST6. At Step ST6, judgment is made about whether or not the variable i for count reaches 8. That is, since a maximum of eight indoor control units (3) are connected to one refrigerant control system (12, 13), judgment is made about whether or not indoor addresses of all the indoor control units (3) are compared with the variable k for group. Then, when the variable i for count does not reach 8, the judgment at Step ST6 is NO so that the routine returns to Step ST6 to repeat the above-mentioned operation. In detail, the indoor address of the indoor control unit (3) having the maximum indoor address out of the indoor control units (3) connected to the outdoor control unit (2) is set as a variable k for group.

Thereafter, when the variable i for count reaches 8, the judgment at Step ST6 is YES so that the routine proceeds to Step ST7. At Step ST7, the system number setting means (25) stores the variable k for group as a system number and transmits it to respective indoor control units (3) connected to the outdoor control unit (2). That is, in each of the refrigerant control systems (12, 13), the indoor address (group number) of the indoor control unit (3) having the maximum indoor address in the system is set as a system number.

Then, when each indoor control unit (3) receives a system signal of the system number from the outdoor control unit (2), the system transmitting means (37) outputs the system signal to the integral controller (4). When the option is set to each indoor control unit (3) by the remote control input means (53), the option transmitting means (36) outputs to the integral controller (4) an option holding signal indicating that the indoor control unit (3) has the option.

Figure 6:
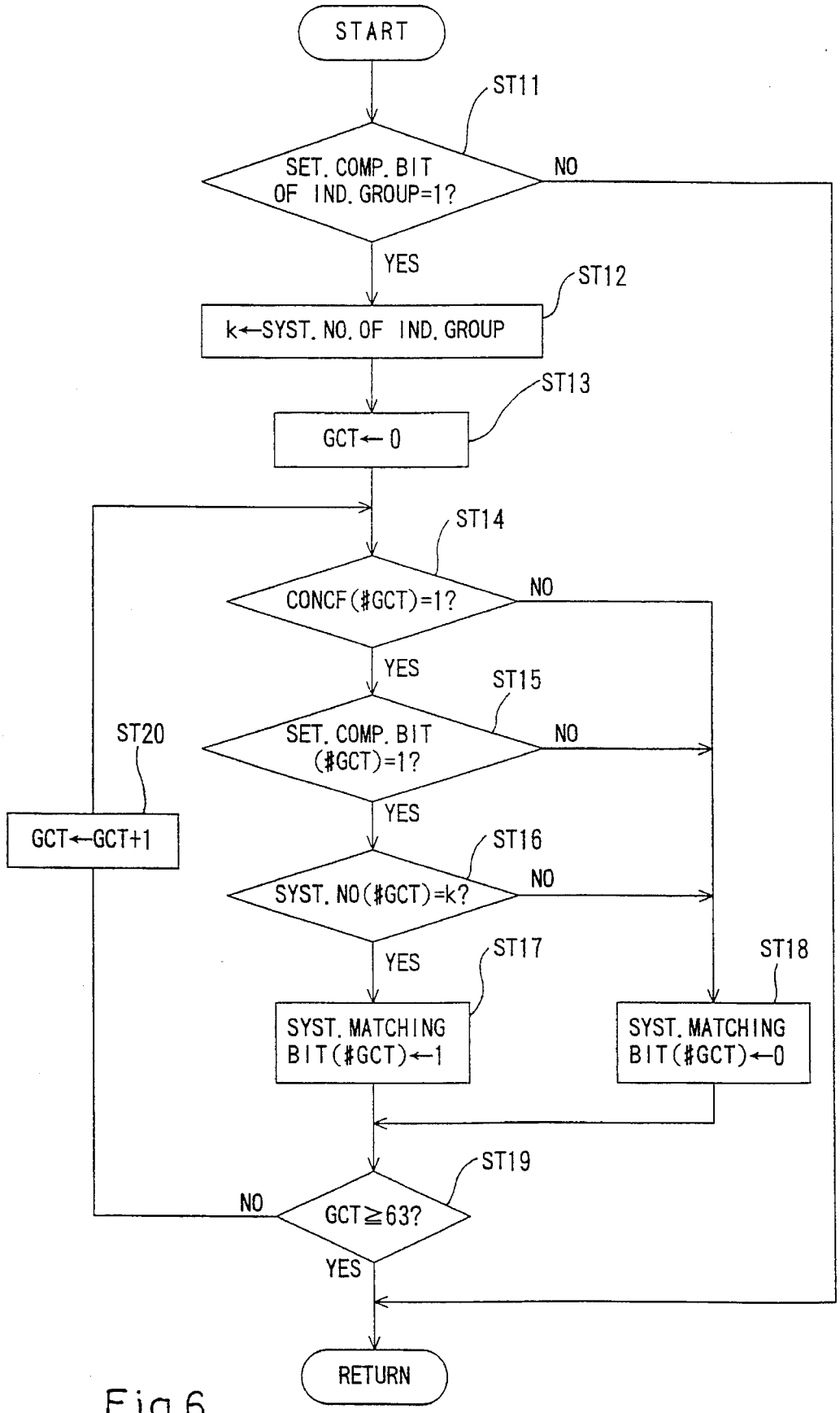
FIG. 6 is a control flow chart for judging an indicative group in the integral controller.
Figure 7:
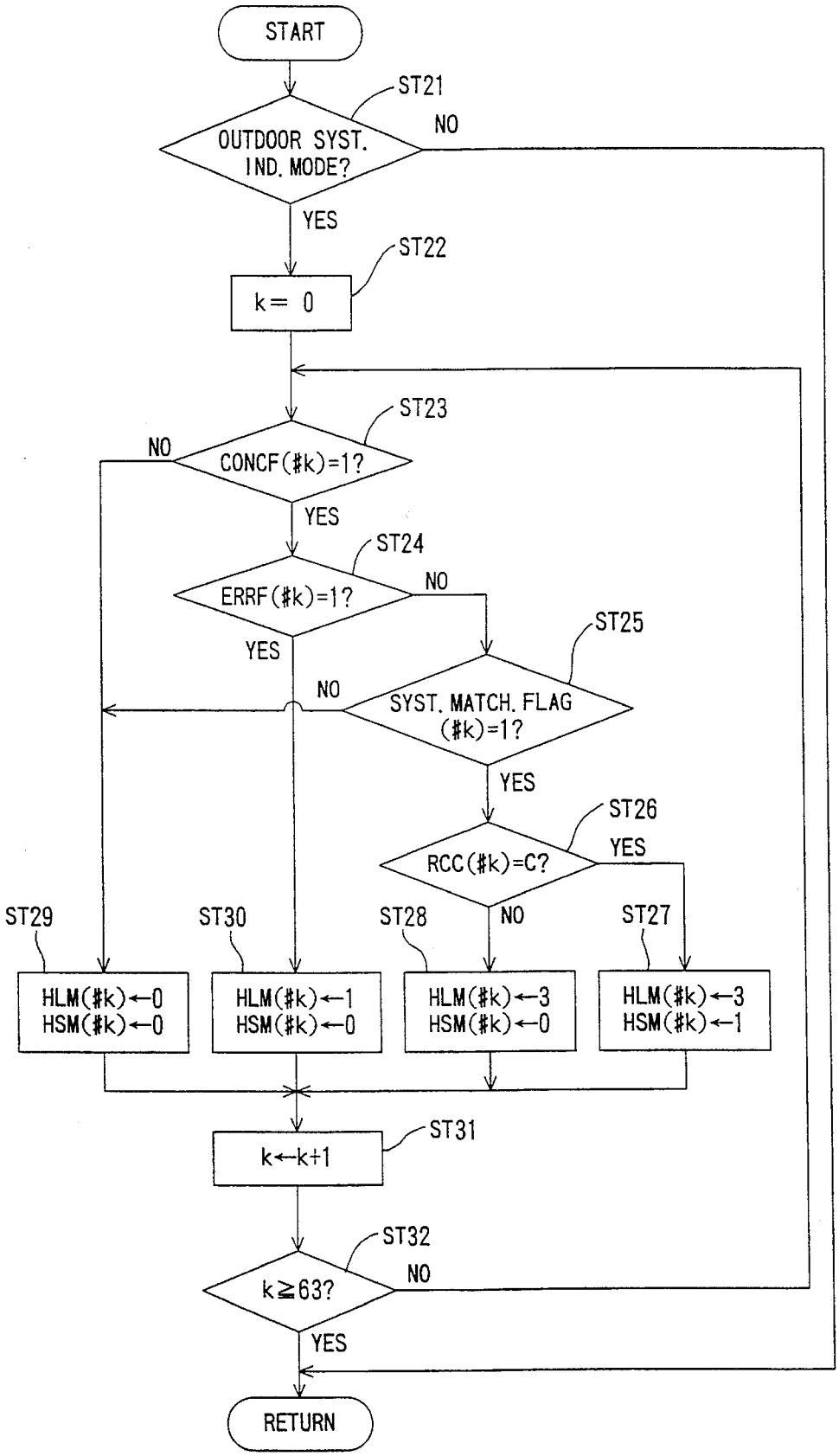
FIG. 7 is a control flow chart for indication in the integral controller.

Next, description is made about a control operation in the integral controller (4) with reference to FIGS. 6 and 7.

First, after the routine starts, at Step ST11, judgment is made about whether or not a setting completion bit of a refrigerant control system (12, 13) to be indicated is set, that is, judgment is made about whether or not transmission is normally made between the integral controller (4) and the indoor control units (3) so that the integral controller (4) can receive system numbers. When the system numbers are not received by the integral controller (4) and have not been set, the routine returns immediately. When the integral controller (4) receives the system numbers, the routine proceeds from Step ST11 to Step ST12. At Step ST12, the system number of the indicative group which is the indicative refrigerant control system (12, 13) to be indicated is set to a variable K for indication.

In detail, the system indicating button (6*a*) of the integral input means (6) is pushed so that the number of the indicative group is inputted as indication instruction information. As mentioned above, the indicative group is a group number and corresponds to the indoor address of the indoor control unit (3) to be indicated. Then, the system number set to the indoor control unit (3) of this indoor address is set to a variable K for indication, and the following data collection is executed every time the system indicating button (6*a*) is pushed.

Then, a group counter GCT which is a counter for indoor address is set to 0 at Step ST13 and then the routine proceeds to Step ST14, where judgment is made about whether or not the connection flag CONCF is set. That is, judgment is made about whether or not the indoor control unit (3) having an indoor address #GCT corresponding to the group counter GCT is connected. Now, since the initial value of the group counter GCT is 0, whether or not the indoor control unit (3) having an indoor address #0 is connected is judged.

When the indoor control unit (3) having the indoor address #GCT corresponding to the group counter GCT is connected, the routine proceeds from Step ST14 to Step ST15. At Step ST15, judgment is made about whether or not a setting completion bit of the indoor control unit (3) having the indoor address #GCT corresponding to the group counter GCT is set.

When the setting completion bit of the indoor control unit (3) is set, the routine proceeds from Step ST15 to Step ST16. At Step ST16, judgment is made about whether or not the system number transmitted from the indoor control unit (3) of the indoor address #GCT corresponding to the group counter GCT is matched with the variable K for indication which is now set. When the system number is matched with the variable K for indication, the routine proceeds from Step ST16 to Step ST17. At Step ST17, a system matching bit is set. When the system number is not matched with the variable K for indication, the routine proceeds from Step ST16 to Step ST18. At Step ST18, the system matching bit is reset.

Thereafter, the routine proceeds from Step ST17 and Step ST18 to Step ST19. At Step ST19, judgment is made about whether or not the group counter GCT reaches 63. Until the group counter GCT reaches 63, the routine proceeds to Step ST20, where the group counter GCT is incremented by 1. Then, the routine returns to Step ST14 so that the above-mentioned operation is repeated.

In detail, since the integral controller (4) may be connected to a maximum of 64 indoor control units (3) so that indoor control units (3) of which the indoor addresses are #0 to #63 may exist, whether or not respective system numbers from the indoor control units (3) are matched with the variable K for indication is judged, the indoor control units (3) of the indicative group inputted from the integral input means (6) are retrieved, and the system matching bit of the matched indoor control unit (3) is set. Then, when the group counter GCT reaches 63, the judgment at Step ST19 is YES so that the routine returns.

In the above Step ST14 and Step ST15, in both the cases where the connection flag CONCF is not set and where the setting completion bit of the indoor control unit (3) is not set, in other words, in both the cases where the indoor control unit (3) of the indoor address #GCT corresponding to the group counter GCT is not connected and where the indoor control unit (3) of the indoor address #GCT corresponding to the group counter GCT does not set its system number, the judgments are NO so that the routine proceeds to Step ST18, where the system matching bit is reset. Then, the routine proceeds to Step ST19, where the above-mentioned operation is repeated.

Description is made next about an indication operation in the integral controller (4) with reference to FIG. 7.

First, after the routine starts, at Step ST21, judgment is made about whether or not the integral controller (4) is in an outdoor system indication mode, i.e., judgment is made about whether or not the system indicating button (6*a*) is ON. When the integral controller (4) is not in the outdoor system indication mode, the routine immediately returns.

On the contrary, when the integral controller (4) is in the outdoor system indication mode, the routine proceeds from Step ST21 to Step ST22. At Step ST22, a variable k for group is set to 0 and then the routine proceeds to Step ST23, where judgment is made about whether or not the connection flag CONCF of the indoor control unit (3) having an indoor address #k corresponding to the variable k for group is set. In detail, judgment is made about whether or not the indoor control unit (3) having the indoor address #k corresponding to the variable k for group is connected. Since the initial value of the variable k for group is 0, judgment is made about whether or not the indoor control unit (3) of the indoor address #0 is connected.

Then, when the indoor control unit (3) of the indoor address #0 corresponding to the variable k for group is connected, the routine proceeds from Step ST23 to Step ST24. At Step ST24, judgment is made about whether or not the indoor control unit (3) of the indoor address #k corresponding to the variable k for group sets a transmission error flag ERRF. Without transmission error, the routine proceeds from Step ST24 to Step ST25. At Step ST25, judgment is made about whether or not the system matching flag of the indoor control unit (3) having the indoor address #k corresponding to the variable k for group is set.

At Step ST17 of FIG. 6, when the system matching flag is set, the routine proceeds from Step ST25 to Step ST26. At Step ST26, judgment is made about whether or not a remote control code RCC of the indoor control unit (3) of the indoor address #k corresponding to the variable k for group is C. The remote control code RCC turns to C when an option is set to any one of indoor control units (3) of each of the refrigerant control systems (12, 13) by the remote control input means (53), while the remote control code RCC turns to A when the option is not set. Accordingly, judgment is made about whether or not the indoor control unit (3) of the indoor address #k corresponding to the present variable k for group has the option.

Then, when the indoor control unit (3) of the indoor address #k corresponding to the present variable k for group has the option, the judgment at Step ST26 is YES so that the routine proceeds to Step ST27. At Step ST27, the system indicating lamp (HLM) is set to 3 and continuously illuminates, while the option indicating lamp (HSM) is set to 1 and continuously flashes. By the illumination and flash, it is indicated that the indoor control unit (3) in question is that of the system number of the indicative group inputted from the integral input means (6) and that capable of changing the driving mode.

On the other hand, at Step ST26, when the indoor control unit (3) of the indoor address #k corresponding to the variable k for group has no option and the remote control code RCC is not C, the judgment is NO so that the routine proceeds to Step ST28. At Step ST28, the system indicating lamp (HLM) is set to 3 and continuously illuminates while the option indicating lamp (HSM) is set to 0 and continues to go out. By the illumination and the going-out of the lamp, it is indicated that the indoor control unit (3) in question is that of the system number of the indicative group inputted by the integral input means (6) but that incapable of changing the driving mode.

When the system matching flag is reset at Step ST25, i.e., when the indoor control unit (3) in question is not matched with that of the system number of the indicative group inputted by the integral input means (6) at Step ST18 of FIG. 6, the judgment is NO so that the routine proceeds to Step ST29. At Step ST29, both of the system indicating lamp (HLM) and the option indicating lamp (HSM) are reset to 0 to continue to go out. By the going-out of the lamps, it is indicated that the indoor control unit (3) in question is that which has not the system number of the indicative group inputted by the integral input means (6).

At Step ST23, when the connection flag CONCF of the indoor control unit (3) having the indoor address #k corresponding to the variable k for group is not set, this means that the indoor control unit (3) of the indoor address #k is not connected. Thus, the judgment is NO so that the routine proceeds to Step ST29. At Step ST29, both of the system indicating lamp (HLM) and the option indicating lamp. (HSM) are reset to 0 to continue to go out.

At Step ST24, when the indoor control unit (3) of the indoor address #k corresponding to the variable k for group sets a transmission error flag ERRF, a transmission error generates. In this case, the judgment is YES so that the routine proceeds to Step ST30. At Step ST30, the system indicating lamp (HLM) is set to 1 to continue to flash, while the option indicating lamp (HSM) is set to 0 to continue to go out. By the flash of the system indicating lamp (HLM), it is indicated that the transmission error generates between the integral controller (4) and the indoor control unit (3) of the indoor address #k corresponding to the present variable k for group.

Thereafter, the routine proceeds from Steps ST27, ST28, ST29 or ST30 to Step ST31 so that the variable k for group is incremented by 1. Then, the routine proceeds to Step ST32, where judgment is made about whether or not the variable k for group reaches 63. Until the variable k for group reaches 63, the routine returns to Step ST23 so that the above-mentioned operation is repeated. In detail, judgment is made to all the indoor control units (3) about whether or not the indoor control unit (3) in question corresponds to the indicative group inputted by the integral input means (6) and judgment is made to all the indoor control units (3) about whether or not the indoor control unit (3) in question has the option. When the above judgments are completed with respect to all the indoor control units (3), respective indication operations are completed so that the routine returns.

Figure 8:
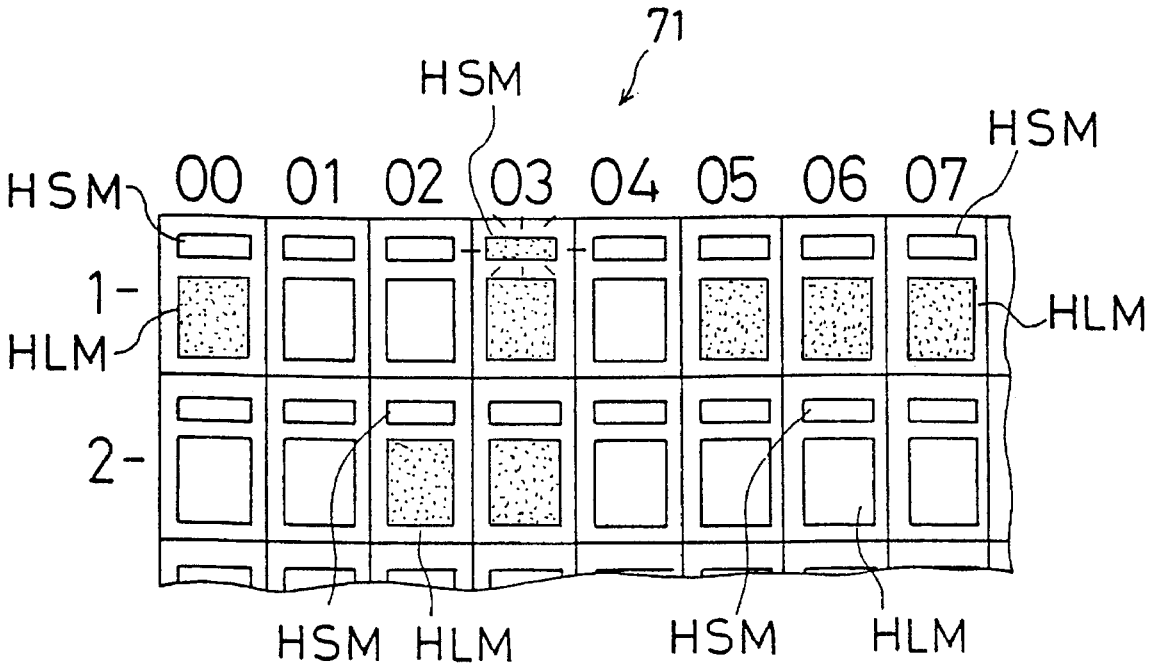
FIG. 8 is a front elevation of main portion of the integral controller showing an example of indication mode.

FIG. 8 shows an example of specific indication modes. When the system indicating button (6a) is pushed so that, for example, the indication mode is set with respect to the indoor control unit (3) of the indoor address 1-00 which is a group number, the system indicating lamps (HLM) of the indoor control units (3) having the indoor addresses 1-00, 1-03, 1-05, 1-06, 1-07, 2-02 and 2-03 respectively illuminate continuously. These illuminations enable to recognize that the above indoor control units (3) belong to one refrigerant control system (12).

Further, out of the indoor control units (3) belonging to one refrigerant control system (12), the option indicating lamp (HSM) of the indoor control unit (3) having the indoor address 1-03 flashes. This flash enables to recognize that the indoor control unit (3) has the option.

Effects of the First Embodiment

According to this embodiment, when an option is set to any one of the indoor control units (3) in each of the refrigerant control systems (12, 13), the indoor control unit (3) having the option is indicated on the integral controller (4). Consequently, the indoor control unit (3) having the option can be readily recognized on the integral controller (4). As a result, switching and management of the driving mode can be made at the integral controller (4) thereby improving operability.

Further, since the outdoor control unit (2) sets the system numbers and the indoor control units (3) belonging to one of the refrigerant control systems (12, 13) are indicated on the integral controller (4), the indoor control units (3) belonging to each of the refrigerant control systems (12, 13) can be readily recognized. As a result, the refrigerant control systems (12, 13) to which respective indoor control units (3) belong can be managed at the integral controller (4) and a check of the systems;just after the installation can be readily made, thereby improving service.

In addition, since the system numbers are automatically set by the outdoor control unit (2), the system numbers can be accurately set and missetting such as duplication can be prevented, thereby resulting in accurate management.

Furthermore, since the indoor control units (3) belonging to each of the refrigerant control systems (12,13) and the indoor control unit (3) having the option are indicated on the integral controller (4), judgment whether a desired indoor control unit (3) is switched in driving mode can be readily made at the integral controller (4) when the driving mode of any one of the indoor control units (3) has been switched. Accordingly, switching of the driving mode can be made readily and accurately at the integral controller (4).

When an indication instruction is inputted, transmission signals outputted from the indoor control units (3) are collected so that -the indoor control unit (3) having the option and the indoor control units (3) belonging to each of the refrigerant control systems (12, 13) are identified. Consequently, the indoor control unit (3) having the option newly and the refrigerant control system (12, 13) can be identified in every indication. As a result, in the cases where the indoor control unit (3) to have the option is changed or where a new air conditioning control system is additionally provided, the indoor control unit (3) having tile option and the refrigerant control system (12, 13) can be accurately identified and indicated.

Further, an indication instruction can be inputted by the system indicating button (6a), thereby simplifying an indication operation.

Furthermore, since a system indication or the like is made by designating one indoor control unit (3) and inputting information thereof, desired information can be obtained by a simple inputting.

In addition, since different lamp indications are made between an option indication and a system indication, this can surely prevent from the misrecognition of confusing the option indication with the system indication.

In particular, since the option indication is indicated by flashing, one indoor control unit (3) having the option can be recognized accurately and readily.

Second Embodiment

Figure 9:
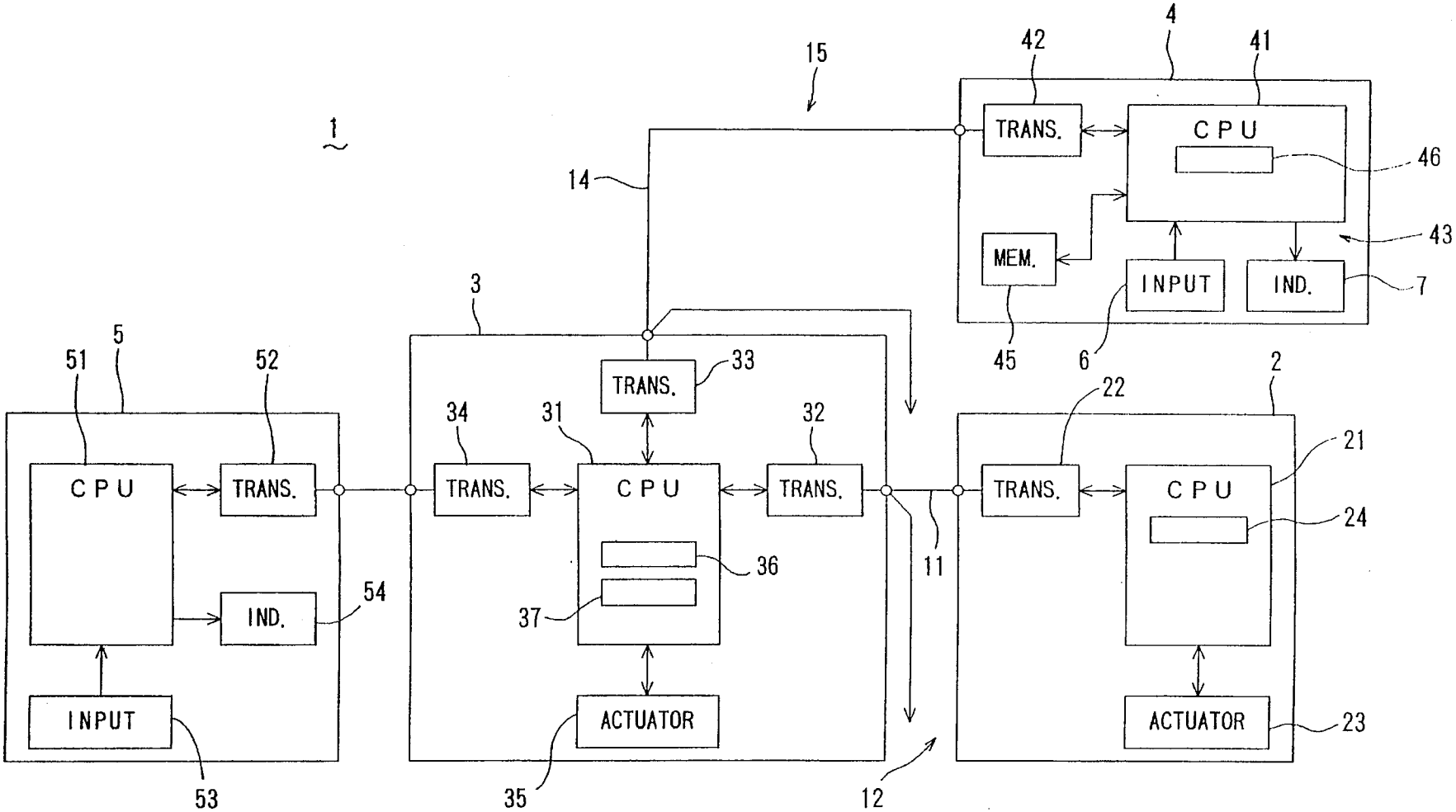
FIG. 9 is a block diagram showing control systems of another embodiment of this invention.

This embodiment shows an embodiment according to claims 7 and 9 of this invention. As shown in FIG. 9, in this embodiment, a memory (45) and a read-out means (46) are provided instead of the data collecting means (44) of the indication executing means (43) of the former embodiment.

In other words, although the former embodiment is so composed that every time the system indicating button (6a) is pushed to carry out an indication instruction, data is collected, the present embodiment is composed so as to, for example, store data in relation to system numbers and data in relation to the presence or absence of the option at the time of installation and the like.

The memory (45) is connected to the integral CPU (41) and forms a storage means for storing data of the indoor control units (3) each having the option based on option holding signals from the option transmitting means (36) and for storing data of the refrigerant control systems (12, 13) to which respective indoor control units (3) belong based on system signals from the system transmitting means (37).

Further, the read-out means (46) is composed, when the system indicating button (6a) is pushed so that indication instruction information is inputted, so as to read out data stored in the memory (45), extract the instructed indoor control unit (3) having the option to output an indication unit signal, and extract the indoor control units (3) belonging to the instructed refrigerant control system (12, 13) to output an indication system signal.

The option indicating lamp (HSM) flashes in response to the indication unit signal of the read-out means (46), while the system indicating lamp (HLM) continuously illuminates in response to the indication system signal.

Other constructions is the same as in the former embodiment.

Control Operations of Second Embodiment

Figure 10:
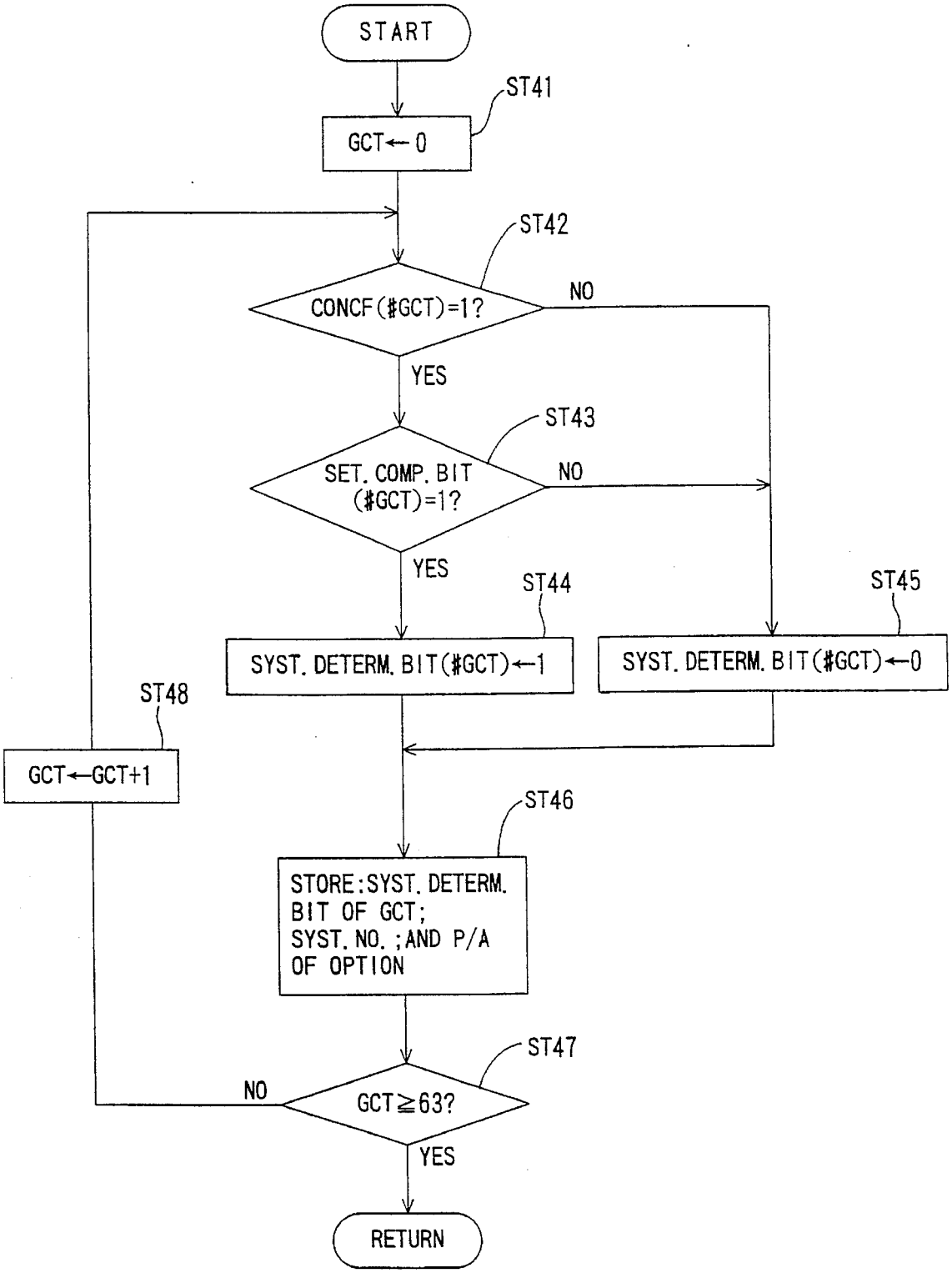
FIG. 10 is a control flow chart for storing data of indicative groups and options in another embodiment of this invention.

Description is made next about a storage operation to the memory (45), with reference to a control flow of FIG. 10.

At the time of installation or the like, as shown in FIG. 5, the system transmitting means (37) of each indoor control unit (3) outputs a system signal to the integral controller (4) when a system number is set by the outdoor control unit (2), and outputs to the integral controller (4) an option holding signal indicating that the option transmitting means (36) has the option when the option is set by the remote control input means (53).

First, at Step ST41, the group counter GCT is set to 0. Thereafter, the routine proceeds to Step ST42 so that judgment is made about whether or not a connection flag CONCF is set. When the indoor control unit (3) of the indoor address #GCT corresponding to the group counter GCT is connected, the routine proceeds to Step ST43, where judgment is made about whether or not a setting completion bit of the indoor control unit (3) of the indoor address #GCT corresponding to the group counter GCT is set.

When the setting completion bit of the indoor control unit (3) is set, the routine proceeds to Step ST44, where a system determination bit of the indoor control unit (3) of the indoor address #GCT corresponding to the group counter GCT is set.

On the contrary, when the connection flag CONCF of the indoor control unit (3) of the indoor address #GCT corresponding to the group counter GCT is not set and when the setting completion bit is not set, the routine proceeds from Step ST42 or Step ST43 to Step ST45. At Step ST45, the system determination bit is reset.

Thereafter, the routine proceeds from Step ST44 or Step ST45 to Step ST46. At Step ST46, the memory (45) writes data of the system determination bit of the indoor control unit (3) of the indoor address #GCT corresponding to the group counter GCT, data of the system number, and data of the presence or absence of the option in the indoor control unit (3) of the system number.

Then, the routine proceeds from Step ST46 to Step ST47 so that the judgment is made about whether or not the group counter GCT reaches 63. Until the group counter GCT reaches 63, the group counter GCT is incremented by 1 at Step ST48 so that the routine returns to Step ST42. In detail, since there may be 64 refrigerant control systems, for example, since 64 indoor control units (3) may be connected to the integral controller (4) in such a manner that one indoor control unit (3) is connected to one outdoor control unit (2), operations from Step ST42 to Step ST46 are performed with respect to the indoor control units (3) belonging to all the refrigerant control systems (12, 13).

Thus, data of the system numbers and the presence or absence of the option in relation to all the indoor control units (3) is written in the memory (45).

Figure 11:
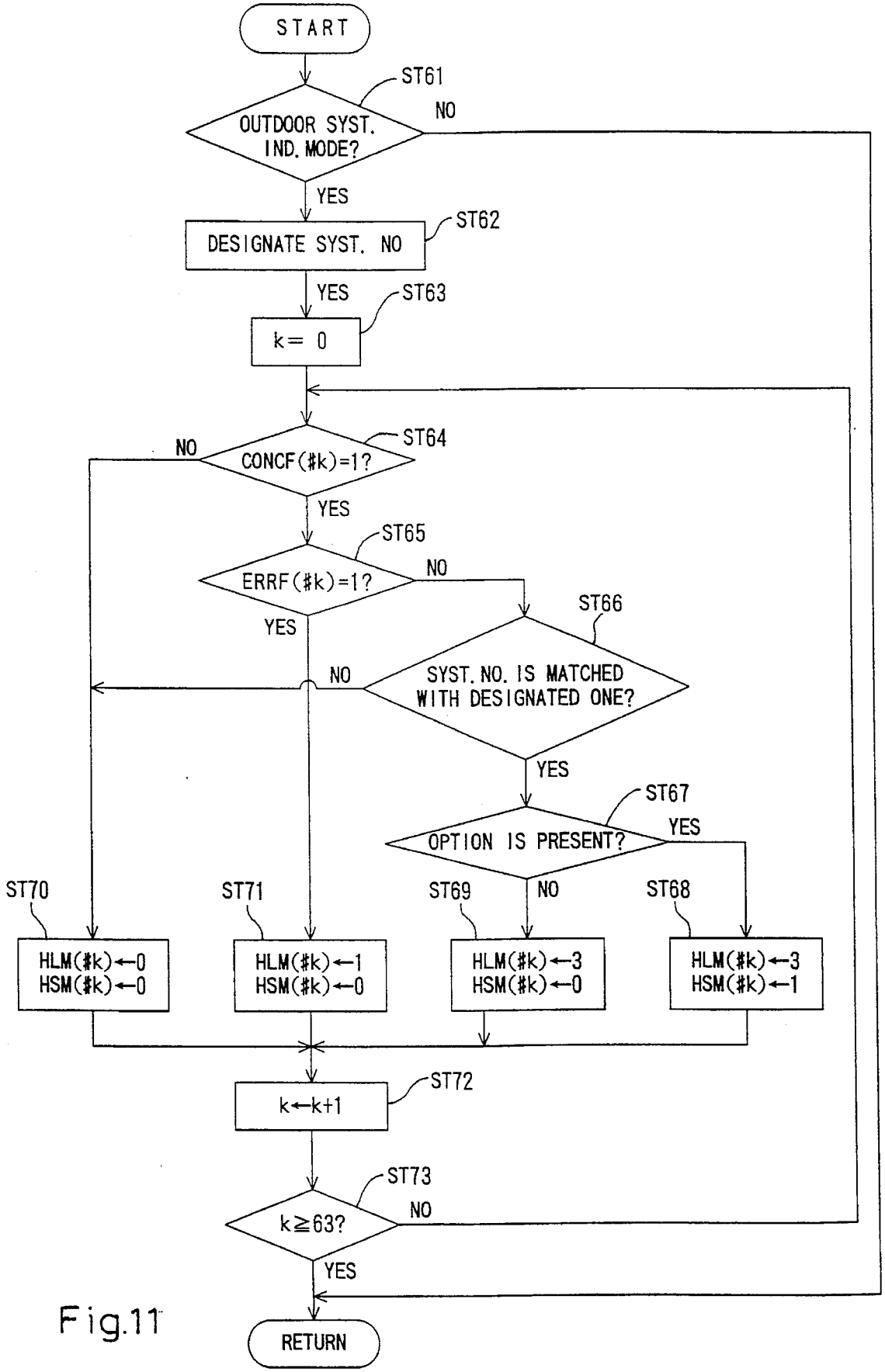
FIG. 11 is a control flow chart for indication in another embodiment of this invention.

Next, description is made about indication operations on the integral controller (4) with :reference to FIG. 11.

First, as in the above-mentioned operation of Step ST21 to Step ST22 of FIG. 7, when the system indicating button (6*a*) is ON, the system number of the refrigerant control system (12, 13) is designated and then the variable k for group is set to 0(Step ST61 to Step ST63).

Thereafter, though posterior steps are similar to the operation of Step ST23 and later of FIG. 7, Step ST25 of FIG. 7 is substituted by Step ST66 of FIG. 11 and Step ST26 of FIG. 7 is substituted by Step ST67 of FIG. 11. At Step ST64, judgment is made about whether or not the connection flag CONCF of the indoor control unit (3) of the indoor address #k corresponding to the variable k for group is set. At Step ST65, judgment is made about whether or not a transmission error flag ERRF is set.

When the connection flag CONCF is set and the transmission error flag ERRF is reset, the read-out means (46) reads out data stored in the memory (45). At Step ST66, judgment is made about whether or not the system number of the indoor control unit (3) of the indoor address #k corresponding to the variable k for group is matched with the designated system number. At Step ST67, judgment is made about whether or not the indoor control unit (3) of the indoor address #k corresponding to the present variable k for group has the option.

Thereafter, when the indoor control unit (3) of the indoor address #k corresponding to the present variable k for group belongs to the designated system number and has the option, the system indicating lamp (HLM) continuously illuminates and the option indicating lamp (HSM) continuously flashes at Step ST68.

On the contrary, when the indoor control unit (3) of the indoor address #k corresponding to the variable k for group does not have the option, the system indicating lamp (HLM) continuously illuminates and the option indicating lamp (HSM) continues to go out at Step ST69.

Further, when the indoor control unit (3) of the indoor address #k corresponding to the present variable k for group does not belong to the designated system number and when the connection flag CONCF is not set, the routine proceeds from Step ST66 and Step ST64 to Step ST70. At Step ST70, both of the system indicating lamp (HLM) and the option indicating lamp (HSM) continue to go out.

When the indoor control unit (3) of the indoor address #k corresponding to the variable k for group set the transmission error flag ERRF, the routine proceeds from Step ST65 to Step ST71, so that the system indicating lamp (HLM) continuously flashes and the option indicating lamp (HSM) continues to go out.

Thereafter, the operation from Step ST64 to Step ST71 is repeated with respect to all the indoor control units (3) (Step ST72 to Step ST73). For example, an indication as shown in FIG. 8 is made.

Other operations are similar to the former embodiment.

Effects of Second Embodiment

According to this embodiment, data of the indoor control units (3) each having the option and the indoor control units (3) belonging to each of the refrigerant control systems (12, 13) is previously stored, and then the indoor control unit (3) having the option and the refrigerant control system (12, 13) are identified from the stored data when an indication instruction is inputted. Accordingly, the indications of the indoor control unit (3) having the option and the refrigerant control system (12, 13) can be immediately made after the indication instruction. As a result, since data is not collected in every indication instruction as in the former embodiment, a prompt integral management can be readily executed.

Other effects are the same an in the former embodiment.

Other Modifications

In the above embodiment, description is made about two refrigerant control systems (12, 13). However, it is a matter of course that this invention may have three or more refrigerant control systems.

Further, in the above embodiments, the remote control (5) is provided with respect to each indoor control unit (3). However, one remote control (5) may be connected to two or more indoor control units (3).

In the driving control devices according to claims 1 to 3 of this invention, only the indoor control unit (3) having the option of the refrigerant control system (12, 13) to which the indoor control units (3) to switch the driving mode and the like belong may be indicated when the system indicating button (6*a*) is ON.

In the driving control devices according to claims 4 to 6 and 11, only all the indoor control units (3) of the refrigerant control system (12, 13) to which necessary indoor control unit (3) belongs may be indicated when the system indicating button (6*a*) is ON.

In the above embodiments, the maximum indoor address out of the indoor addresses of the indoor control units (3) belonging to each of the refrigerant control systems (12, 13) is set as the system number. However, the system number is not limited to the indoor address, that is, it is essential only that the system numbers of refrigerant control systems (12, 13) are things different from each other.

In the driving control devices according to claims 1 to 10 of this invention, indication of a refrigerant control system (12, 13) or the like on the integral controller (4) are not of course limited to that of the above embodiments.

[INDUSTRIAL FIELD OF UTILIZATION]

As described above, according to a driving control device for an air conditioner of this invention, a control system and an option of an indoor control unit are indicated on an integral controller. Thus, in the case where many indoor units are provided in a large-scale building or the like, all the indoor units can be integrally managed at a single place.

We claim:

1. A driving control device for an air conditioner having:

a plurality of air conditioning control systems (12, 13) each so formed that a plurality of user-side control units (3) are connected to a thermal source side control unit (2) via a transmission line (11); and an integral control system (15) so formed that an integral control unit (4) is connected to all the user-side control units (3) via a transmission line (14), said driving control device comprising:

an option means (53) for setting, to any one of the user-side control units (3) of each of the air conditioning control systems (12, 13), an option which enables a switching operation of a driving mode of the air conditioning control system (12, 13);

an option transmitting means (36) provided in each of the user-side control units (3) for outputting an option holding signal when the option is set to the user-side control unit (3) by the option means (53);

an indication input means (6*a*) provided in the integral control unit (4) for inputting an indication instruction for indicating a required user-side control unit (3) out of the user-side control units (3) each having the option; and an indication executing means (43) provided in the integral control unit (4) for indicating the instructed user-side control unit (3) having the option based on the option holding signal transmitted from the option transmitting means (36) of the user-side control unit (3) when receiving the indication instruction from the indication input means (6*a*).

2. A driving control device for an air conditioner according to claim 1, wherein the indication executing means (43) has:

a data collecting means (44) for, when inputting the indication instruction from the indication input means (6*a*), collecting transmission signals from all the user-side control units (3) which each include the option holding signal and extracting the instructed user-side control unit (3) having the option to output an indication unit signal; and an option indicating means (HSM) for indicating the user-side control unit (3) having the option in response to the indication unit signal of the data collecting means (44).

3. A driving control device for an air conditioner according to claim 1, wherein the indication executing means (43) has:

a storage means (45) for storing data of the user-side control units (3) each having the option based on the option holding signals of the option transmitting means (36);

a read-out means (46) for, when inputting the indication instruction from the indication input means (6*a*), reading out data stored in the storage means (45), extracting the instructed user-side control unit (3) having the option and then outputting the indication unit signal; and an option indicating means (HSM) for indicating the user-side control unit (3) having the option in response to the indication unit signal of the read-out means (46).

4. A driving control device for an air conditioner having:

a plurality of air conditioning control systems (12, 13) each so formed that a plurality of user-side control units (3) are connected to a thermal source side control unit (2) via a transmission line (11); and an integral control system (15) so formed that an integral control unit (4) is connected to all the user-side control units (3) via a transmission line (14), said driving control device comprising:

a system number setting means (25) provided in the thermal source side control unit (2) for setting respective system numbers of the air conditioning control systems (12, 13) to respective user-side control units (3) connected to the thermal source side control unit (2), storing the system numbers and outputting system signals of the system numbers;

a system transmitting means (37) provided in each of the user-side control units (3) for receiving a system signal outputted from the system number setting means (25), storing the system signal and outputting the system signal;

an indication input means (6*a*) provided in the integral control unit (4) for inputting an indication instruction for indicating the user-side control units (3) belonging to required one of the air conditioning control systems (12, 13); and an indication executing means (43) provided in the integral control unit (4) for indicating, when inputting the indication instruction from the indication input means (6*a*), the user-side control units (3) belonging to the instructed air conditioning control system (12, 13) based on the system signals transmitted from the system transmitting means (37) of the user-side control units (3).

5. A driving control device for an air conditioner according to claim 4, wherein the indication executing means (43) has:

a data collecting means (44) for, when inputting the indication instruction from the indication input means (6*a*), collecting transmission signals from all the user-side control units (3) which each include the system signal and extracting the user-side control units (3) belonging to the instructed air conditioning control system (12, 13) to output an indication system signal; and a system indicating means (HLM) for indicating the user-side control units (3) in response to the indication system signal of the data collecting means (44).

6. A driving control device for an air conditioner according to claim 4, wherein the indication executing means (43) has:

a storage means (45) for storing data of the air conditioning control systems (12, 13) to which respective user-side control units (3) belong based on the system signals of the system transmitting means (37);

a read-out means (46) for, when inputting the indication instruction from the indication input means (6*a*), reading out data stored in the storage means (45), and extracting the user-side control units (3) which belong to the instructed air conditioning control unit (12, 13) to output an indication system signal; and a system indicating means (HLM) for indicating the user-side control units (3) in response to the indication system signal of the read-out means (46).

7. A driving control device for an air conditioner having:

a plurality of air conditioning control systems (12, 13) each so formed that a plurality of user-side control units (3) are connected to a thermal source side control unit (2) via a transmission line (11); and an integral control system (15) so formed that an integral control unit (4) is connected to all the user-side control units (3) via a transmission line (14), said driving control device comprising:

an option means (53) for setting, to any one of the user-side control units (3) of each of the air conditioning control systems (12, 13), an option which enables a switching operation of a driving mode of the air conditioning control system (12, 13);

a system number setting means (25) provided in the thermal source side control unit (2) for setting respective system numbers of the air conditioning control systems (12, 13) to respective user-side control units (3) connected to the thermal source side control unit (2), storing the system numbers and outputting system signals of the system numbers;

an option transmitting means (36) provided in each of the user-side control units (3) for outputting an option holding signal when the option is set to the user-side control unit (3) by the option means (53);

a system transmitting means (37) provided in each of the user-side control units (3) for receiving a system signal outputted from the system number setting means (25), storing the system signal and outputting the system signal;

an indication input means (**6*a*) provided in the integral control unit (4) for inputting an indication instruction for indicating a required user-side control unit (3) out of the user-side control units (3) which each have the option and indicating the user-side control units (3) belonging to a required one out of the air conditioning control systems (12, 13); and an indication executing means (43) provided in the integral control unit (4) for, when inputting the indication instruction from the indication input means (6*a*), indicating the instructed user-side control unit (3) having the option based on the option holding signal transmitted from the option transmitting means (36) of the user-side control unit (3), and indicating the user-side control units (3) belonging to the instructed air conditioning control system (12, 13) based on the system signals transmitted from the system transmitting means (37) of the user-side control units (3**).

8. A driving control device for an air conditioner according to claim 7, wherein the indication executing means (43) has:

a data collecting means (44) for, when inputting the indication instruction from the indication input means (**6*a*), collecting transmission signals from all the user-side control units (3) which each include the option holding signal and the system signal, extracting the instructed user-side control unit (3) having the option to output an indication unit signal, and extracting the user-side control units (3) belonging to the instructed air conditioning control system (12, 13**) to output an indication system signal;

an option indicating means (HSM) for indicating the user-side control unit (3) having the option in response to the indication unit signal of the data collecting means (44); and a system indicating means (HLM) for indicating the user-side control units (3) in response to the indication system signal of the data collecting means (44).

9. A driving control device for an air conditioner according to claim 7, wherein the indication executing means (43) has:

a storage means (45) for storing data of the user-side control units (3) each having the option based on the option holding signals of the option transmitting means (36) and for storing data of the air conditioning control systems (12, 13) to which respective user-side control units (3) belong based on the system signals of the system transmitting means (37);

a read-out means (46) for, when inputting the indication instruction from the indication input means (**6*a*), reading out data stored in the storage means (45), extracting the instructed user-side control unit (3) having the option to output an indication unit signal, and extracting the user-side control units (3) belonging to the instructed air conditioning control system (12, 13**) to output an indication system signal;

an option indicating means (HSM) for indicating the user-side control unit (3) having the option in response to the indication unit signal of the read-out means (46); and a system indicating means (HLM) for indicating the user-side control units (3) in response to the indication system signal of the read-out means (46).

10. A driving control device for an air conditioner according to any one of claims 1 to 9, wherein the indication input means (**6*a***) is an indicating button for inputting the indication instruction with the push of the indicating button.

11. A driving control device for an air conditioner according to any one of claims 4 to 6, wherein in order to indicate the user-side control units (3) belonging to any one of the air conditioning control systems (12, 13), the indication input means (**6*a*) inputs indication instruction information designating one user-side control unit (3) belonging to that one of the air conditioning control systems (12, 13**).

12. A driving control device for an air conditioner according to any one of claims 7 to 9, wherein in order to indicate the user-side control unit (3) having the option of any one of the air conditioning control systems (12, 13) and indicate the user-side control units (3) belonging to that one of the air conditioning control systems (12, 13), the indication input means (**6*a*) inputs indication instruction information designating one user-side control unit (3) belonging to that one of the air conditioning control systems (12, 13**).

13. A driving control device for an air conditioner according to any one of claims 1 to 3 and 7 to 9, wherein the option indicating means (HSM) is an option indicating lamp which flashes in response to the indication unit signal.

14. A driving control device for an air conditioner according to any one of claims 4 to 9, wherein the system indicating means (HLM) is a system indicating lamp which continuously illuminates in response to the indication system signal.

* * * * *